US010468814B2

(12) United States Patent
Xu

(10) Patent No.: US 10,468,814 B2
(45) Date of Patent: Nov. 5, 2019

(54) PLUG STRIP

(71) Applicant: Shenzhen Orico Technologies Co., Ltd., Shenzhen, Guangdong (CN)

(72) Inventor: Yeyou Xu, Shenzhen (CN)

(73) Assignee: Shenzhen Orico Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/085,499

(22) PCT Filed: Mar. 13, 2017

(86) PCT No.: PCT/CN2017/076458
§ 371 (c)(1),
(2) Date: Sep. 14, 2018

(87) PCT Pub. No.: WO2017/185888
PCT Pub. Date: Nov. 2, 2017

(65) Prior Publication Data

US 2019/0067871 A1 Feb. 28, 2019

(30) Foreign Application Priority Data

Apr. 25, 2016 (CN) ..... 2016 2 0356154 U

(51) Int. Cl.

| | |
|---|---|
| ***H01R 13/52*** | (2006.01) |
| ***H01R 13/447*** | (2006.01) |
| ***H01R 25/00*** | (2006.01) |
| ***H01R 13/70*** | (2006.01) |
| ***H01R 27/00*** | (2006.01) |

(52) U.S. Cl.
CPC ..... *H01R 13/5213* (2013.01); *H01R 13/447* (2013.01); *H01R 25/006* (2013.01); *H01R 13/70* (2013.01); *H01R 27/00* (2013.01)

(58) Field of Classification Search
CPC .. H01R 13/5213; H01R 13/447; H01R 13/52; H01R 13/70; H01R 27/00
See application file for complete search history.

(56) References Cited

U.S. PATENT DOCUMENTS

| | | | | |
|---|---|---|---|---|
| 7,654,855 | B2 * | 2/2010 | Liao | H01R 13/60 439/441 |
| 8,043,116 | B2 * | 10/2011 | Liao | H01R 13/60 439/535 |
| 2011/0309591 | A1 * | 12/2011 | Petrick | H01R 13/465 280/47.35 |

FOREIGN PATENT DOCUMENTS

| | | |
|---|---|---|
| CN | 201918593 U | 8/2011 |
| CN | 203150855 U | 8/2013 |

(Continued)

OTHER PUBLICATIONS

Search Report and Written Opinion, dated May 11, 2017, corresponding to International Application No. PCT/CN2017/076458 (filed Mar. 13, 2017), parent of the present application, 10 pp.

*Primary Examiner* — Briggitte R. Hammond
(74) *Attorney, Agent, or Firm* — Leydig, Voit & Mayer, Ltd.

(57) ABSTRACT

A plug strip. A cover capable of covering receptacles is hingedly connected to a receptacle end face; and a first notch and a second notch are respectively provided at both side edges of the cover. During use, an electrical wire passes through the first notch or the second notch to be plugged into the receptacle or a USB output interface, so that the cover can be kept closed. Therefore, dust pollution and occurrence of an electric shock accident due to long-time use can be effectively prevented.

4 Claims, 2 Drawing Sheets

(56) References Cited

FOREIGN PATENT DOCUMENTS

| | | | |
|---|---|---|---|
| CN | 204230959 | U | 3/2015 |
| CN | 105186230 | A | 12/2015 |
| CN | 204905583 | U | 12/2015 |
| CN | 105428889 | A | 3/2016 |
| CN | 20581121 | U | 12/2016 |

* cited by examiner

PLUG STRIP

CROSS-REFERENCE TO RELATED APPLICATIONS

This application is a U.S. National Stage Application filed under 35 U.S.C. § 371 of International Application No. PCT/CN2017/076458, filed Mar. 13, 2017, which claims the benefit of Chinese Application No. CN 201620356154.9, filed Apr. 25, 2016. Both of these applications are hereby incorporated by reference in their entireties.

TECHNICAL FIELD

The present disclosure relates to a power strip (plug strip).

BACKGROUND ART

Power strip is a mobile socket, also known as a plug board or a trailer board. It is an indispensable tool for people in their daily life and brings convenience to them. However, the power strips in our daily life in most of the cases are provided with exposed receptacles. In addition, the receptacle end face has to be exposed to the outside in use. As a result, a long time of use tends to lead to dust accumulation or other foreign substances falling into the receptacles, which may lead to electric shock accidents, as a human body touching a power strip with exposed receptacles would do under wet conditions.

SUMMARY

The primary purpose of this disclosure is to provide a power strip, which is designed to prevent the power strip from dust accumulation after a longtime of use, as well as to stop the occurrence of electrical shock accidents.

To achieve the foregoing purpose, the embodiments of this disclosure provide a power strip which includes a power strip body. A cover is hinged with a receptacle end face (i.e., an end face provided with receptacles) of the power strip body, and USB output interfaces are provided on a USB-output-interface end face (i.e., an end face provided with a USB output interface) of the power strip body. The cover is provided with a first notch and a second notch, and the first notch and the second notch are distributed correspondingly at the edges of two sides of the cover.

Further, the receptacle end face is provided with a groove fitting edges of the cover.

Further, the receptacle end face is provided with a first power switch as well as several receptacles, and the receptacles are electrically connected with the first power switch.

Further, the USB-output-interface end face is provided with a second power switch, and the USB output interface is electrically connected with the second power switch.

Further, the output voltage of the USB output interfaces is 5V.

Further, the output current of the USB output interfaces is 2.1 A.

Further, the output voltage of the receptacles is adjustable, with the output voltage of the receptacles ranging from 110V to 220V.

In the power strip of the present disclosure, a cover capable of covering the receptacles is hinged to the receptacle end face, and is provided with a first notch and a second notch on the edges of its two sides, and thereby electrical leads may access the receptacles and the USB output interfaces through the first notch and the second notch in use so that the cover keeps covering the receptacles. This can effectively prevent the power strip from dust pollution after a long time of use and stop the occurrence of electric shock accidents.

DESCRIPTION OF THE DRAWINGS

In order to illustrate the technical solutions of the embodiments in the present disclosure or in the prior art more clearly, the figures required in the description of the embodiments or the prior art will be introduced briefly below. Obviously, the figures in the following description merely show some embodiments of this disclosure. Those ordinarily skilled in the art still can further obtain other relevant figures according to the structures illustrated by these figures, without paying inventive effort.

DESCRIPTION OF REFERENCE NUMERALS

TABLE 1

Figure 1:
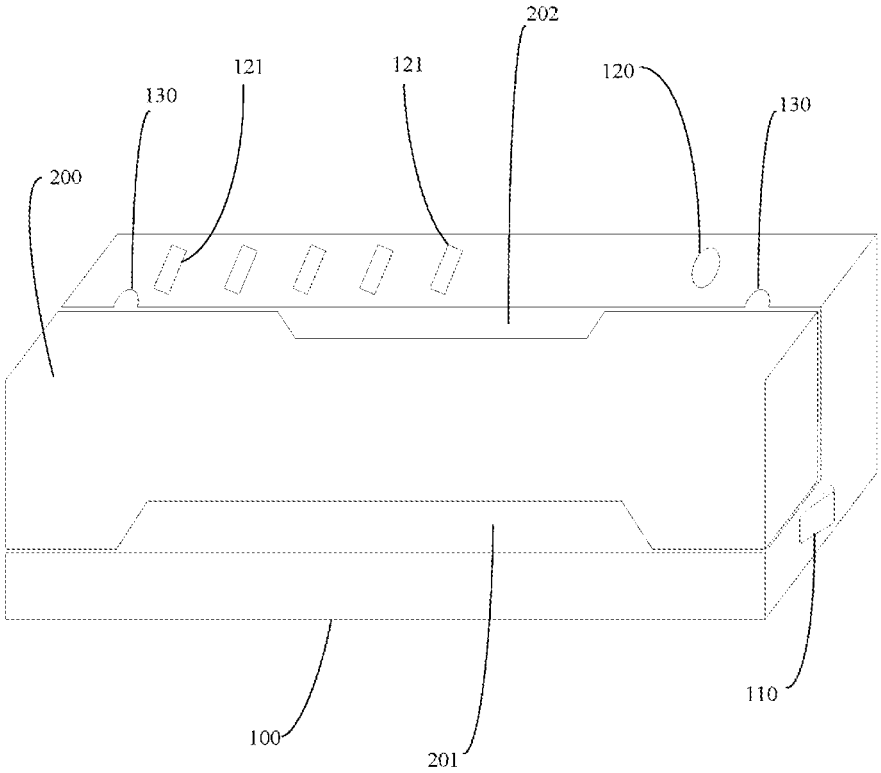
FIG. 1 is a schematic structural diagram of a power strip with its cover closed according to an embodiment of this disclosure.

| Reference numeral | Name | Reference sign | Name |
|---|---|---|---|
| 100 | Power strip body | 130 | Hinge |
| 110 | First power switch | 140 | groove |
| 111 | Receptacle | 200 | cover |
| 120 | Second power switch | 201 | First notch |
| 121 | USB output interface | 202 | Second notch |

How the purpose of the present purpose is achieved, and the functional features and advantages of the present disclosure will be further illustrated with reference to the accompanying drawings and in combination with the embodiments.

DETAILED DESCRIPTION OF EMBODIMENTS

Now, the technical solutions of the embodiments of the present disclosure will be described clearly and comprehensively by referring to the accompanying drawings in the embodiments of this disclosure. It is apparent that the embodiments to be described are only some, but not all, of the embodiments of the present disclosure. All of the other embodiments obtained by those ordinarily skilled in the art from the embodiments of the present disclosure without making an inventive effort will fall within the protection scope claimed in the present disclosure.

It should be noted that all of the directional indications (such as up, down, left, right, front, rear, etc.) in the embodiments of this disclosure are only used to explain the relative location relation, movement and the like between the components in a specific configuration (as shown in the drawings). If the specific configuration changes, change should also take place in the directional indications accordingly.

Additionally, it is noted in the description of the present disclosure that the terms, such as "first" and "second", are used only for the purpose of description, and should not be construed as indicating or implying a relative importance or implying the number of technical features indicated therein. Therefore, features defined with the terms, "first", "second" may explicitly or implicitly include at least one such feature. Additionally, the technical solutions in the embodiments may be combined with one another, but such combination must be achievable for those ordinarily skilled in the art. When the combined technical solutions are contradict or unachievable, it would be accepted that such combined technical solutions neither are existent, nor fall within the scope of protection as claimed in the present disclosure.

The embodiments of the present disclosure provide a power strip which is designed to prevent the power strip from dust accumulation due to a long time of use as well as to stop the occurrence of electric shock accidents.

Figure 2:
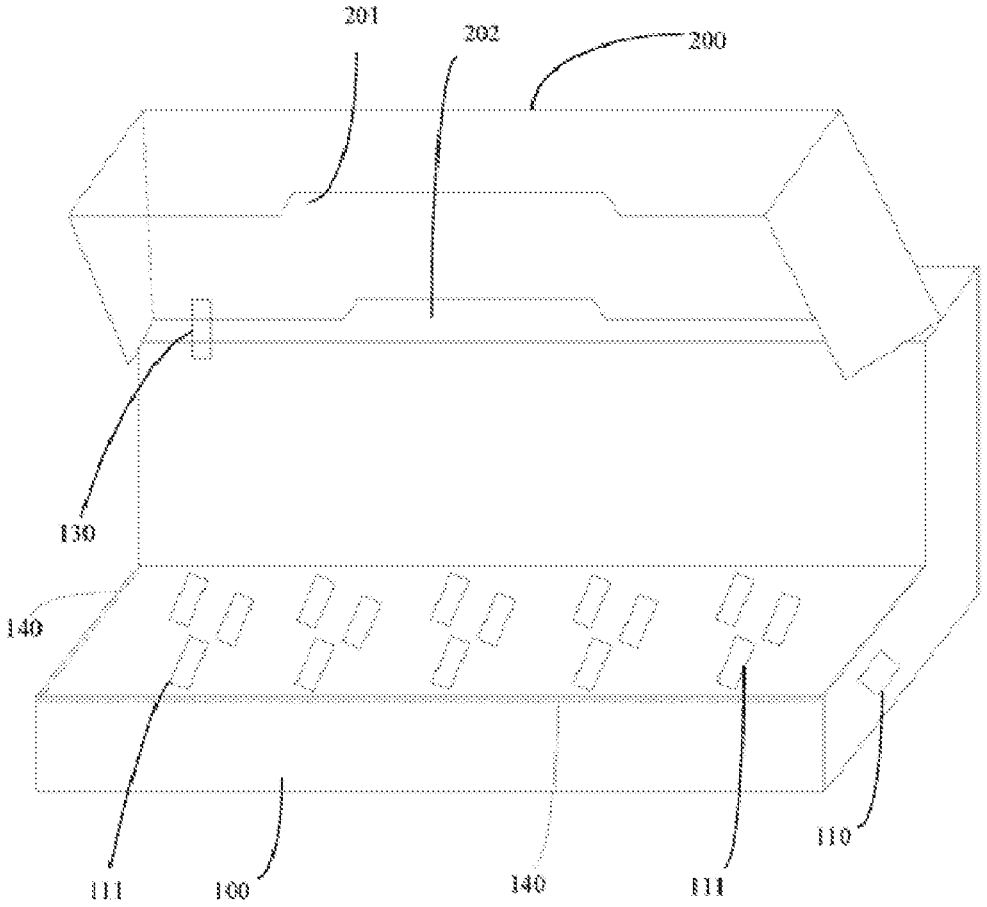
FIG. 2 is a schematic structural diagram of a power strip with its cover open according to an embodiment of this disclosure.

With reference to FIG. 1 to FIG. 2, the power strip in one embodiment of the present disclosure includes a power strip body 100. The power strip body 100 includes a receptacle end face hinged with a cover 200 and includes a USB-output-interface end face provided with USB output interfaces 121. The cover 200 is provided with a first notch 201 and a second notch 202, and the first notch 201 and the second notch 202 are correspondingly distributed at the side edges of the cover 200.

The power strip body 100 in this embodiment is L-shaped and made of insulating plastics by injection molding in a way that two end faces are formed, one at a lower position and the other at a higher position, namely, the USB-output-interface end face and the receptacle end face. The cover 200 is also made of insulating plastics, and is made, through injection molding, into an L shape in a way that it fits the L-shaped structure of the power strip body. The cover 200 and the power strip body 100 are both formed with the hinge structures required for hinging while in the injection molding. For example, a hinge formed by a single plug pin is provided where the receptacle end face and the cover 200 is hinged, or a hinge formed by a plug pin and a compression spring together, so that the cover 200 may be rotated upward and downward along the axis of the plug pin, enabling opening and closing. During the injection molding of the power strip body 100, there are a plurality of USB output interfaces 121 formed on the USB-output-interface end face.

During the injection molding, the cover 200 is provided, at the edges of its two sides, with a first notch 201 and a second notch 202 correspondingly, which are trapezoidal-shaped, and the first notch 201 and the second notch 202 are constructed in a way that they are able to receive electrical leads of different diameters, make it easy to place power leads, and contribute to heat dissipation.

The power strip of the present disclosure makes it possible to flexibly open and close the cover 200 and the closing is more secure, by hinging the cover 200 to the receptacle end face of the power strip body 100. The closed cover 200 can effectively prevent the power strip body 100 from dust pollution after a long time of use and prevent other foreign substances falling into the receptacles, which may cause electric shock accidents during use. Moreover, a plurality of USB output interfaces are provided on a different end face so as to provide a plurality of low-voltage DC power outputs at the same time.

Further, with reference to FIG. 1 to FIG. 2, the receptacle end face is provided with grooves 140 that fit the edges of the cover 200.

The power strip body 100 of this embodiment is provided, by the injection molding, with grooves 140 fitting the edges of the cover 200 on the receptacle end face, and the grooves 140 can exactly receive the edges of the cover 200. Providing such grooves on the receptacle end face of the power strip body 100 that fit the edges of the cover 200 allows the cover to be closed more tightly and thus makes it easy to move the entire power strip.

Further, with reference to FIG. 1 to FIG. 2, the receptacle end face is provided with a first power switch 110 and several receptacles 111. The receptacles 111 are electrically connected with the first power switch 110. The end face where the USB output interface 121 is provided is provided with a second power supply 120. The USB output interfaces 121 are electrically connected with the second power switch 120.

The power strip body 100 of this embodiment is formed with two end faces during the injection molding, one at a higher position and the other at a lower position. One end face becomes the receptacle end face, and the other becomes the USB-output-interface end face. Two independent voltage regions form on the receptacle end face and the USB-output-interface end face, providing power supplies of different voltages to the outside, and they are provided with a first power switch 110 and a second power switch 120 respectively as a way to control the power outputs of the independent voltage regions separately. The receptacles 111 are distributed on the receptacle end face and connected, through its internal metal conductor, with and controlled by the first power switch 110 which is also located at the receptacle end face. The USB output interfaces 121 are distributed on the USB-output-interface end face and connected, through its internal metal conductor, with and controlled by the second power switch 120 located on the USB-output-interface end face.

The power strip of the present disclosure is provided with different power output end faces on different end faces, and further provided with a first power switch on the receptacle end face and a second power switch on the USB-output-interface end face as a way to facilitate simultaneous or separate output.

Further, with reference to FIG. 1, the output voltage/current of the USB output interfaces 121 is 5V/2.1 A.

In this embodiment, as for the USB output interfaces 121, a transformer provided in the USB output region is used to step down the AC 220V power for the USB output interfaces 121, so as to satisfy the needs of the low-voltage DC input terminals. The output voltage/current of the USB output interfaces 121 is set to 5V/2.1 A, which can meet the needs of fast charging.

Further, with reference to FIG. 2, the output voltage of the receptacles 111 is adjustable, with the output voltage of the receptacles ranging from 110V to 220V.

In this embodiment, a combination of sliding resistors provided in the output regions of the AC power supply is used to divide the AC 220V power for the receptacles 111, making it easy to make adjustments to satisfy the needs of different AC power outputs. The output voltage of the receptacles is designed to range from 110V to 220V, which satisfies the needs of using different types of electrical equipment.

The above embodiments are merely the preferred embodiments of the present disclosure and are not intended to limit the patentable scope of the present disclosure. Any equivalent structural modifications made from the description as well as the accompanying drawings, or any direct/indirect uses of the present disclosure in other related technical fields all should fall into the scope of patent protection of the present disclosure under the inventive concept of the present disclosure.

The invention claimed is:

1. A power strip, comprising a power strip body, wherein a receptacle end face of the power strip body is hinged with a cover, and a USB-output-interface end face of the power strip body, is provided with a USB output interface, the cover being provided with a first notch and a second notch, and the first notch and the second notch are correspondingly distributed at edges of two sides of the cover, wherein the power strip body is formed by injection molding into an L-shaped structure, the receptacle end face and the USB-output-interface end face are located at a lower plane and a higher plane of the L-shaped structure respectively, an edge of the cover is hinged with the USB-output-interface end face through a hinge, to allow the cover to be closed to cover the receptacle end face, wherein the receptacle end face is provided with a first power switch and several receptacles, and the receptacles are electrically connected with the first power switch; wherein the USB-output-interface end face is provided with a second power switch, and the USB output interface is electrically connected with the second power switch.

2. The power strip according to claim 1, wherein the receptacle end face is provided with a groove fitting edges of the cover.

3. The power strip according to claim 1, wherein output voltage of the USB output interface is 5V.

4. The power strip according to claim 1, wherein output current of the USB output interface is 2.1 A.

* * * * *